United States Patent [19]

Agatahama

[11] Patent Number: 4,490,903

[45] Date of Patent: Jan. 1, 1985

[54] CONTACT SWITCHING DEVICE PRODUCTION METHOD

[75] Inventor: Shunichi Agatahama, Osaka, Japan

[73] Assignee: Omron Tateisi Electronics Co., Nagaokakyo, Japan

[21] Appl. No.: 384,592

[22] Filed: Jun. 3, 1982

Related U.S. Application Data

[63] Continuation of Ser. No. 214,629, Dec. 10, 1981, Pat. No. 4,419,640.

[30] Foreign Application Priority Data

Dec. 17, 1979 [JP] Japan ..... 54-163922
Nov. 13, 1980 [JP] Japan ..... 55-160426

[51] Int. Cl.[3] ..... H01H 11/00
[52] U.S. Cl. ..... 29/622; 200/6 R
[58] Field of Search ..... 29/622, 882, 883, 884; 335/106, 162, 128, 202; 200/1 A, 6 R, 6 C, 16 C, 16 D, 159 A, 245, 250, 283

[56] References Cited

U.S. PATENT DOCUMENTS 3,889,087 6/1975 Graeff ..... 335/106
4,292,613 9/1981 Bando et al. ..... 335/106

*Primary Examiner*—Howard N. Goldberg
*Assistant Examiner*—P. W. Echols
*Attorney, Agent, or Firm*—Wegner & Bretschneider

[57] ABSTRACT

There is provided a method of producing a contact switching device comprising a step of pressing an electrically conductive metal sheet to form a lead frame having at least one relatively resilient contact member extending from one of the terminal portions and a stationary contact member extending from the other terminal portion, the relatively resilient contact member and the stationary contact member being disposed in mutually opposed and spaced apart relation, a step of bending external rim portions of the lead frame while the relatively resilient contact member is biased in such a manner that the opposed relatively resilient contact member and stationary contact member are brought together into partially overlapping relation, a molding step for forming an insulating base at base portions of the two terminal members, and a terminal-forming step of cutting the lead frame to leave the two terminal portions. The contact switching device as produced in the above manner, which has several advantages, is also described.

4 Claims, 12 Drawing Figures

CONTACT SWITCHING DEVICE PRODUCTION METHOD

REFERENCE TO APPLICATIONS

This application is a continuation of U.S. Pat. application Ser. No. 214,629, filed 12/10/81 now U.S. Pat. No. 4,419,640.

BRIEF SUMMARY OF THE INVENTION

Production of electromagnetic relays has been conventionally performed by securing at least one external terminal member and one movable member to an insulating base by welding, by caulking or otherwise. And a terminal member carrying a movable contact point and a terminal member carrying a stationary contact point are independently embedded by insert-molding into insulating base materials and the two insulated moldings are subsequently joined with a connective member so as to provide an electrical contact assembly. In such conventional manufacturing method, the contact structure is made up of a fairly large number of parts and the process involves many assembling steps and, hence, provides for only an inadequate mechanical stability of the final products.

An object of this invention is to provide a contact switching device which lends itself to continuous and automatic production. It is another object of this invention to provide a continuous method for producing such a contact switching device. These and other objects of this invention will become apparent from the following detailed description of preferred embodiments shown on the accompanying drawings.

DETAILED DESCRIPTION OF THE INVENTION

Figure 1:
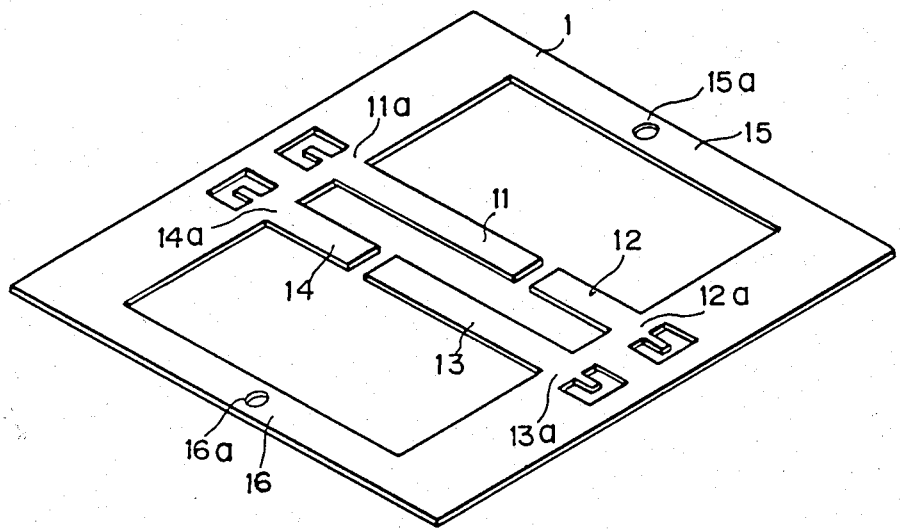
FIGS. 1 and 2 each is a perspective view of the lead frame in the course of production of an embodiment of this invention.
Figure 2:
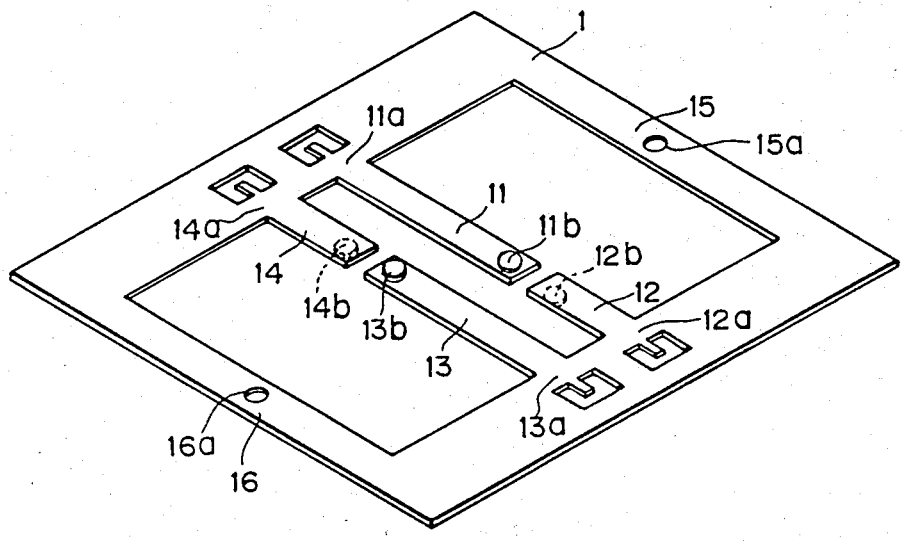
Figure 3:
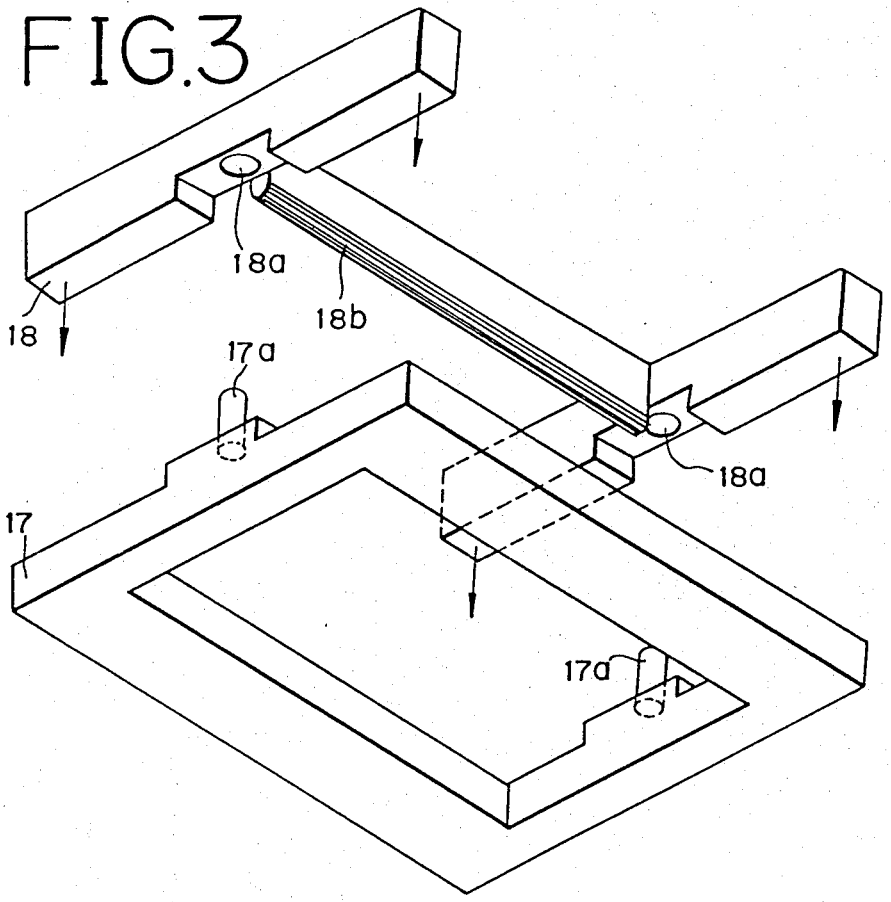
FIG. 3 is a perspective view showing an exemplary tool for bending external rim portions of the lead frame.
Figure 4:
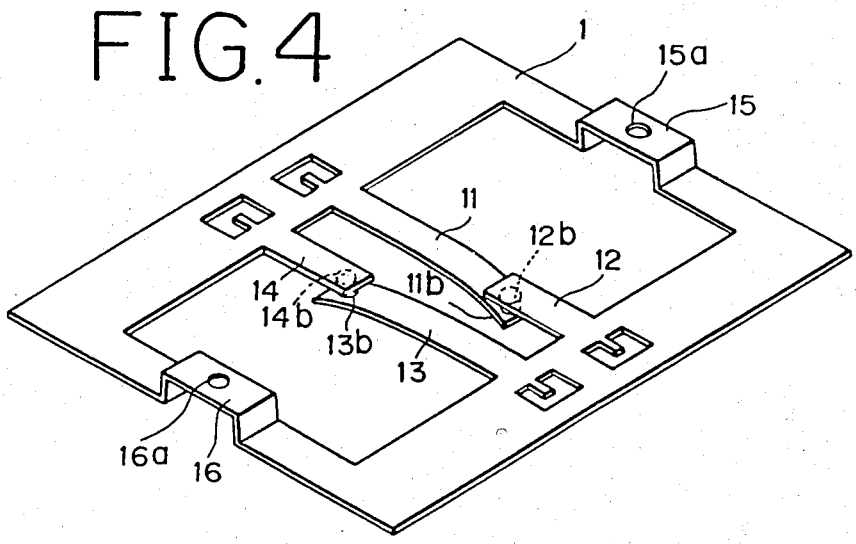
FIG. 4 is a perspective view showing the bent lead frame as formed by means of the tool illustrated in FIG. 3.
Figure 5:
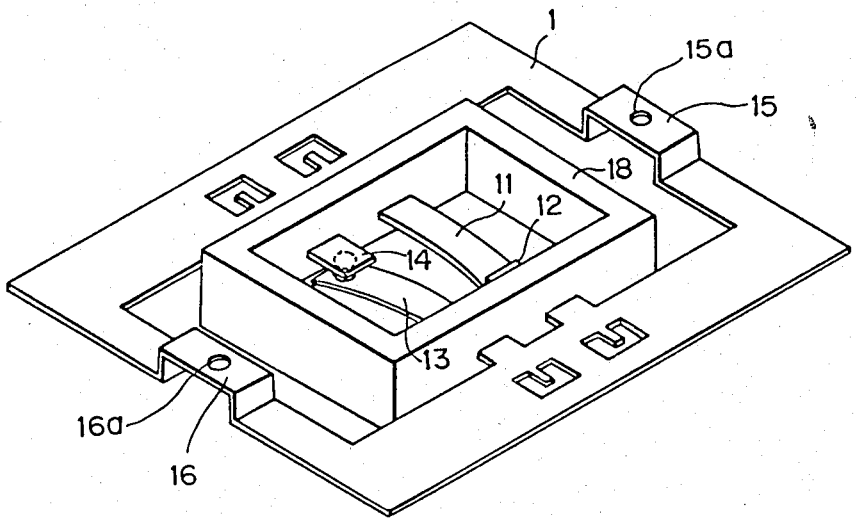
FIGS. 5 and 6 each is a perspective view showing the contact mechanism which illustrates a subsequent production stage.
Figure 6:
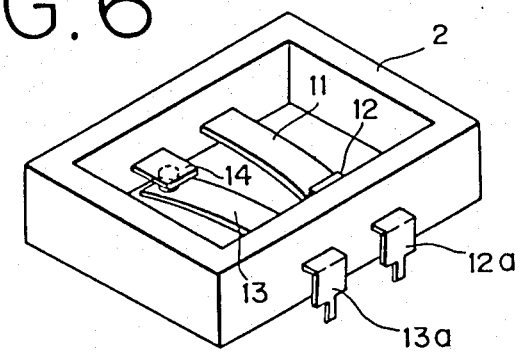

In FIG. 1 which illustrates an embodiment of this invention as viewed from the top side, an electrically conductive metal sheet is pressed to provide a lead frame 1 including relatively resilient movable contact members 11 and 13 and relatively rigid stationary contact members 12 and 14, all of which members are contiguous to the remainder thereof at their terminal portions 11*a*, 12*a*, 13*a* and 14*a*. The lead frame 1 is made of a material having a sufficient resiliency such as phosphorbronze or berrylium bronze. Referring to FIG. 2, which is a view taken in the same direction as that of FIG. 1, there is provided a step for forming contact points on the above-mentioned members of the lead frame, viz. movable contact points 11*b* and 13*b* at the ends of said relatively resilient contact members 11 and 13 and stationary contact points 12*b* and 14*b* at the ends of said stationary contact members 12 and 14, respectively. Each of the contact points is made, for example, of a composite material with a noble metal element exposed and welded or otherwise secured to the corresponding contact member. In a next production stage, the lead frame 1 is bent by means of a press assembly consisting of a die 17 and a punch 18 as illustrated in FIG. 3 to provide a bent-up lead frame 1 as depicted in FIG. 4. In the form illustrated in FIG. 4, external rim portions 15 and 16 of the lead frame 1 are raised relative to the remainder of the frame 1 with the confronting pairs of relatively resilient contact members 11 and 13 and rigid stationary contact members 12 and 14 being brought into overlapping relationship in such a manner that said movable contact points 11*b* and 13*b* will be in registry with said stationary contact points 12*b* and 14*b*, respectively. In this production stage, projections 17*a* of the forming die 17 are engaged into pilot holes 15*a* and 16*a* in the lead frame 1 and the lead frame 1 is positioned overhead the die 17. In this arrangement, a central projection 18*b* of the punch 18 which is descending depresses the relatively flexible contact members 11 and 13 to clear them from the ends of stationary contact members 12 and 14, thus allowing each of the cooperating pairs of members to lie one over another. In the resulting form shown in FIG. 4, the relatively resilient contact members 11 and 13 have been flexed as much as the height of the contact points, with the result that the energy accumulated by this flexure provides a sufficient contact pressure. With the lead frame 1 having the above-described contact mechanism, an insulating base 2 is molded by insert molding as illustrated in FIG. 5 which is a top perspective view similar to FIG. 6. The insulating base 2 is a vertically open frame structure which ensures the dimensional stability of the lead frame 1 and, therefore, of said contact mechanism. The molding stage is followed by cutting and bending stages where the connecting parts of bases 11*a*, 12*a*, 13*a* and 14*a* are cut and bent to provide a couple of independent contacts as illustrated in FIG. 6. Finally, a contact drive assembly (not shown) comprising an electromagnet for depressing the relatively resilient contact members 11 and 13 in a rocking motion is disposed over the lead frame 1 via the top opening of the insulating base 2. The above procedure provides a finished electromagnetic relay. Alternatively, an externally controllable actuator may be disposed in lieu of said electromagnet contact drive so as to provide a manual switch. If the lead frame 1 is not cut before the assembling of the contact drive, etc., automatic assembly can be accomplished using the lead frame as a carrier. Further, if the lead frame 1 is provided as a continuous hoop, automatic production up to the assembling of the contact drive can be accomplished in a film-carrier system.

The above-described production method makes for an improvement in electric conductivity because of the integral formation of said relatively resilient contact members 11 and 13 with said bases 11*a* and 13*a*, and the securing step such as welding, caulking, etc. can be omitted. Moreover, the registration of contact points can be accomplished accurately and automatically without causing deformation of contact members. Since the lead frame 1 is a single integral unit even after registry of contact points, the transfer and insertion of the frame into the mold can be automatically performed by mechanical means. Thus, this invention permits an extensive automation of the production process with considerable cost savings. Moreover, since a necessary contact pressure can be obtained by selecting the proper height of contacts, any desired contact pressure can be achieved on molding the base 2 without entailing an unstable flexing operation for the resilient contact members. Furthermore, because all the molding process required is that for the insulating base 2, the process is simple and contributes to a cost reduction. It should be understood that in the molding of the insulating base 2, such other devices as hinge means for the contact drive, coil terminal supports, etc. can be simultaneously molded. Since the product of this invention is very simple in construction, it can be small-sized and is structurally robust. Moreover, because the base 2 is vertically exposed, the product is readily accessible for the adjustment of contact pressure.

Although a couple of contacts are formed simultaneously in the above embodiment, the invention is equally applicable to a one-contact structure or a multiple-contact structure. In any event, the cost and operation are virtually unchanged except for the costs of raw materials. Moreover, the contacts may be so arranged that the rocking motion of the contact drive (not shown) provides for one of the contacts acting as a make contact and the other contact as a break contact. If the base 11*a* of relatively resilient contact member 11 and the base 14*a* of terminal member 14 are short-circuited in the base 2, the terminal constituted by the bases 11*a* and 14*a* will function as a common terminal so that a switch contact structure providing for switching to either one of bases 12*a* and 13*a* can be constructed.

Although not shown in FIGS. 5 and 6, the insulating base 2 may be molded with an insulating barrier at a position intermediate between the two contacts, in which case the pole-to-pole short circuits due to arcing can be precluded and the strength of the base 2 itself can be increased. Such an insulating barrier will be more fully described with reference to the embodiment described hereinafter.

It should be understood that in the particular embodiment described above, the contact points 11*b* and 14*b* are disposed at the free ends of contact members 11 and 14 but these contact points may be omitted if desired. Then, a necessary and sufficiently large contact pressure may be ensured by controlling the bending angle of the external rim portions 15 and 16.

Figure 7:
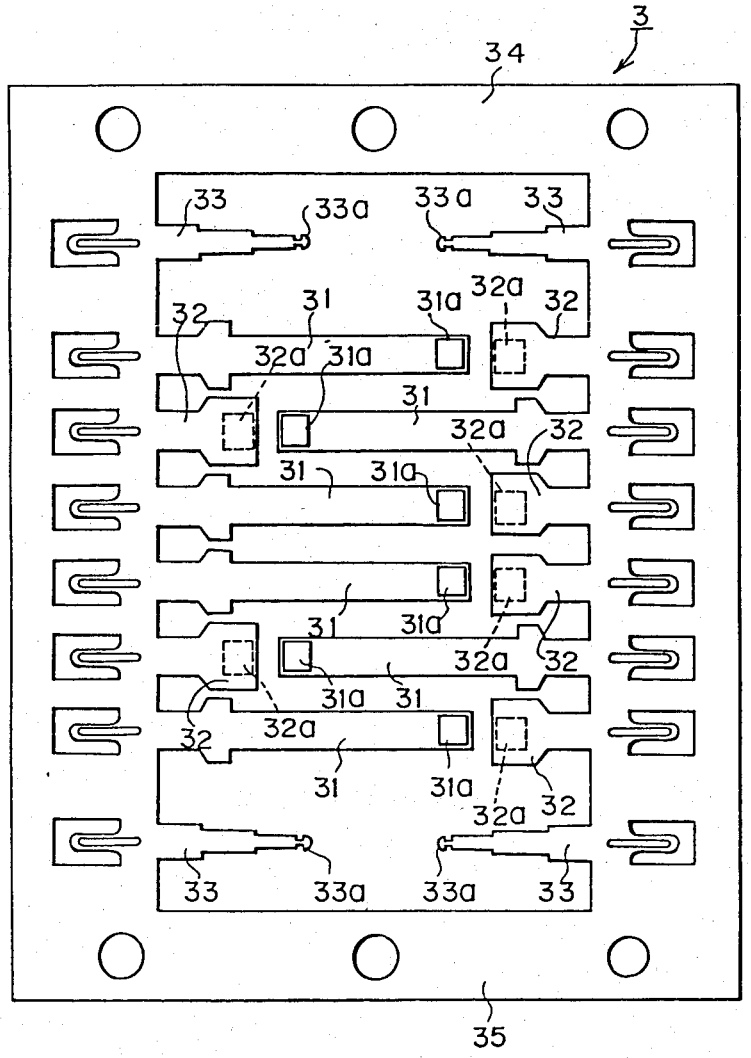
FIG. 7 is a top plan view of the lead frame showing a first production stage in the embodiment of FIG. 2.
Figure 8:
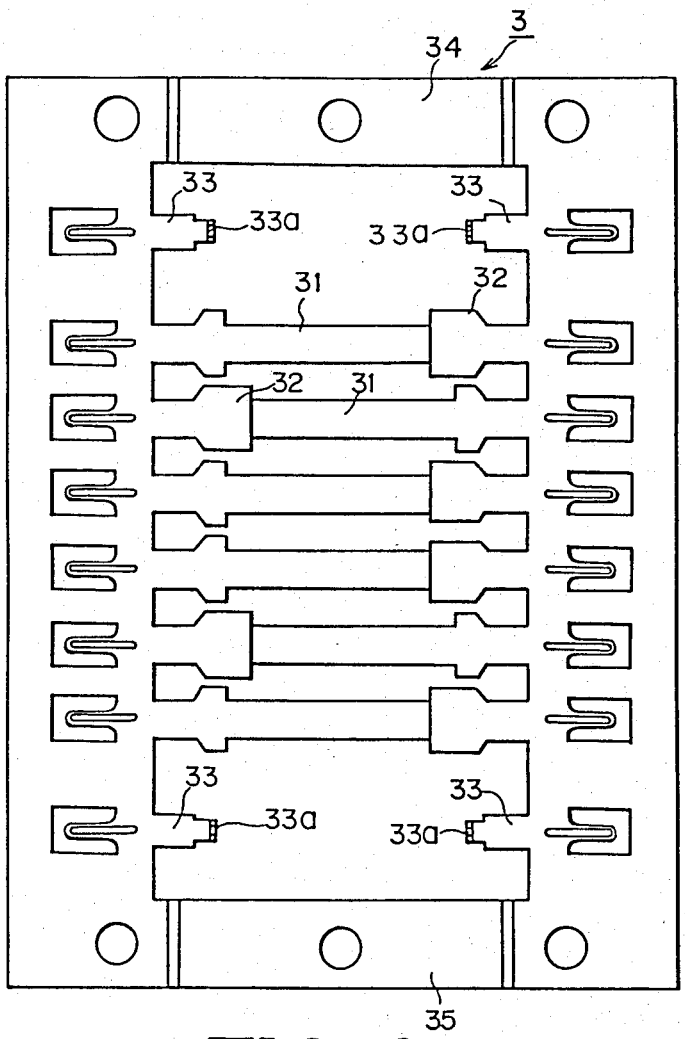
FIG. 8 is a top plan view showing a subsequent production stage.
Figure 9:
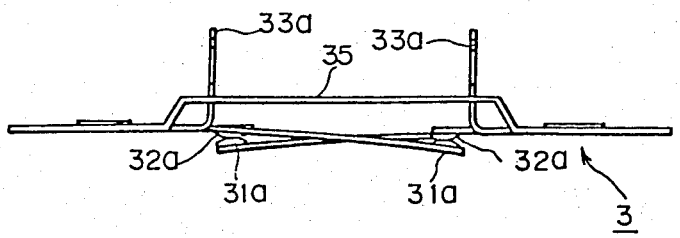
FIG. 9 is a side elevation view of FIG. 8.

The following description pertains to an electromagnetic relay as another embodiment of this invention. Referring, first, to FIG. 7, there is shown a lead frame 3 which is fabricated by a press operation. This lead frame 3 has a multiplicity of resilient contact members 31 and terminal or stationary contact members 32 in opposed and staggered relation, with a total of 4 coil terminal members 33 being located at both ends. Each of the coil terminal members has a connector 33*a*. Referring, further, to FIG. 7, a movable contact point 31*a* and a stationary contact point 32*a* are welded to the face side of each resilient contact member 31 and the reverse side of each terminal member 32, respectively. Then, by means of a die-and-punch set analogous to that shown in FIG. 3, the lead frame 3 is pressed as its relatively resilient contact members 31 are biased in a downward direction. In the condition shown in FIGS. 8 and 9, external rim portions 34 and 35 of the frame 3 have been bent and the confronting pairs of relatively resilient contact members 31 and stationary contact members 32 have been brought into partially overlapping relationship, with the movable contact points 31*a* and stationary contact points 32*a* being located in alignment. The connectors 33*a* of said coil terminal members 33 have also been bent as best shown in FIG. 9 which is an elevation view.

Figure 11:
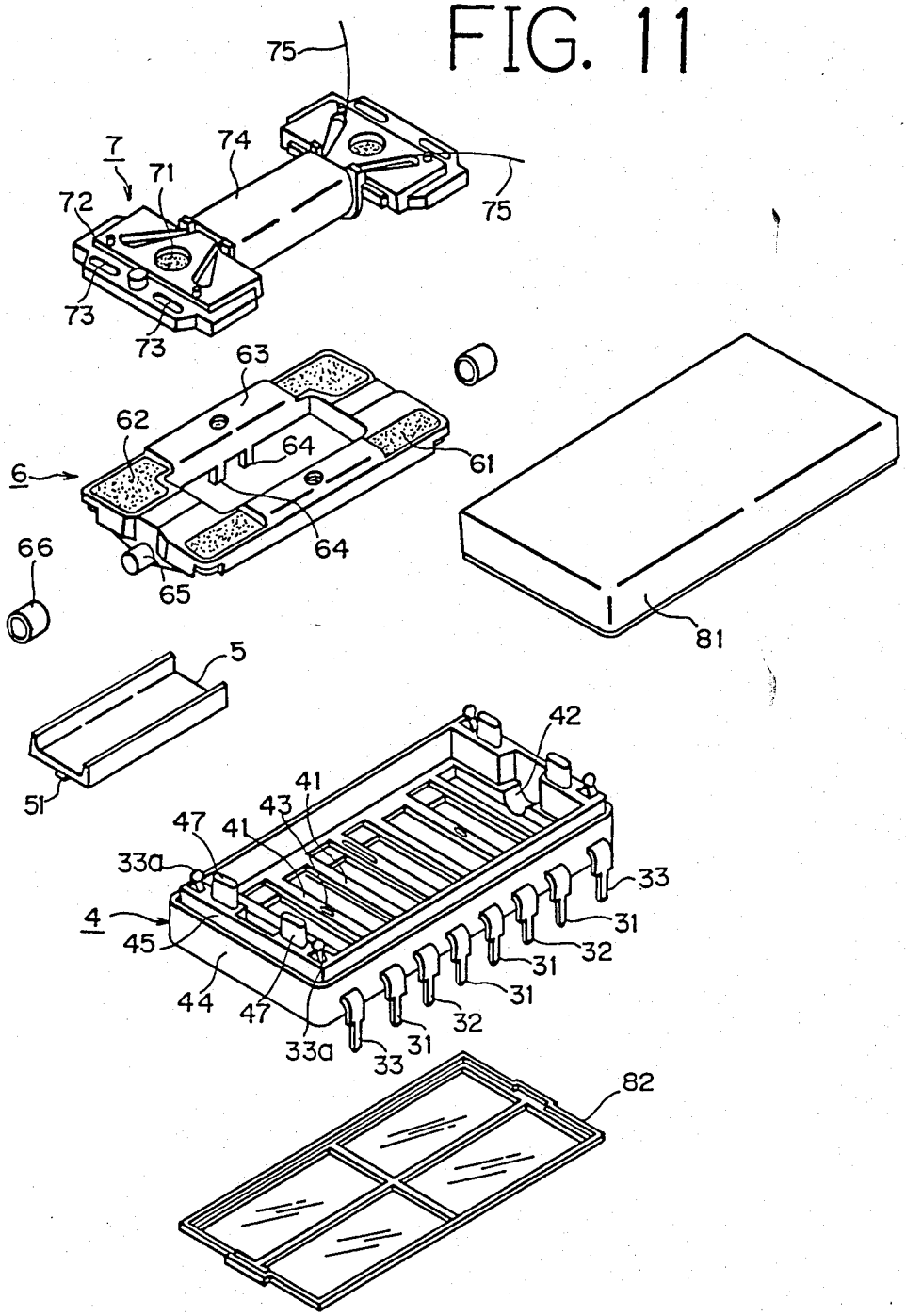
FIG. 11 is an exploded perspective view of an electromagnetic relay as the second embodiment of this invention.
Figure 10:
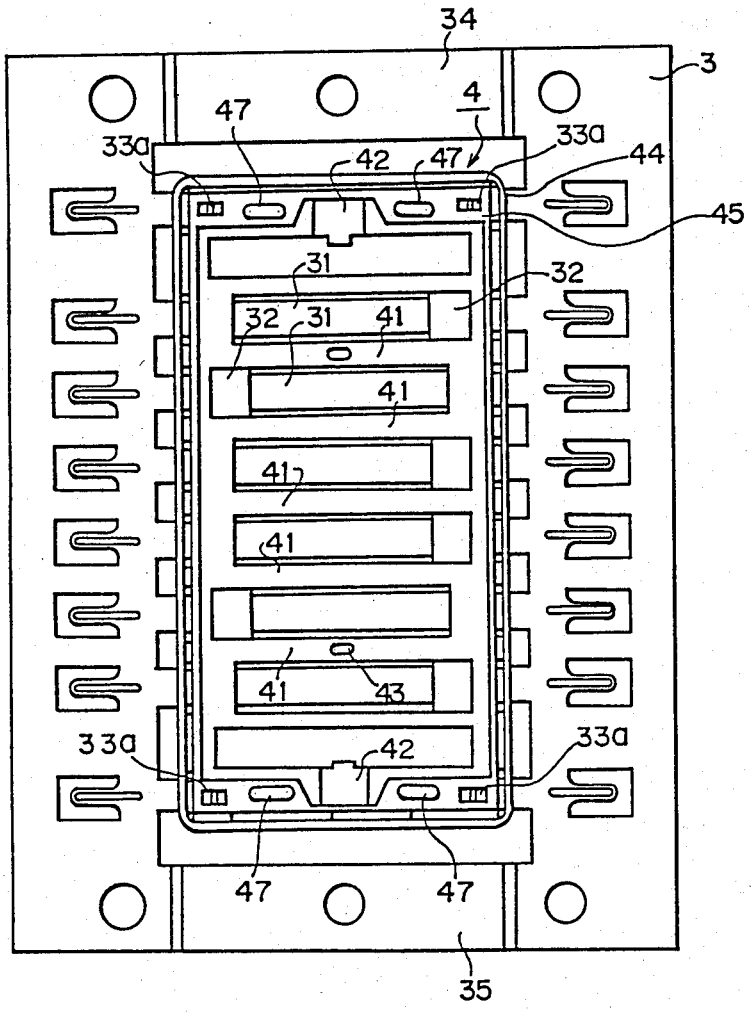
FIG. 10 is a plan view showing a subsequent production stage.

The above lead frame 3 is then embedded in an insulating resin by insert molding to provide a base 4 as shown in FIG. 10. Then, the bridging portions connecting the bases of externally extending lead terminals of said relatively resilient contact members 31 and terminal members 32 are cut to provide independent terminals which are further bent as shown in FIG. 11. The above procedure provides a finished contact structure. The above-mentioned insulating resin base 4 is generally shaped like a box and has insulating walls 41, arcuate recesses 42 for accommodating journals, and holes 43 for the positioning of an insulating plate, all at its bottom side. Moreover, the base 4 has a double-wall lateral structure, consisting of an outer wall 44 and an inner wall 45, with the provision of a channel extending vertically through the entire thickness of the base. Moreover, both ends of said inner wall 45 have upwardly extending projections 47, and the connectors 33*a* of coil terminal members 33 project up similarly from the top of the inner wall 45.

Figure 12:
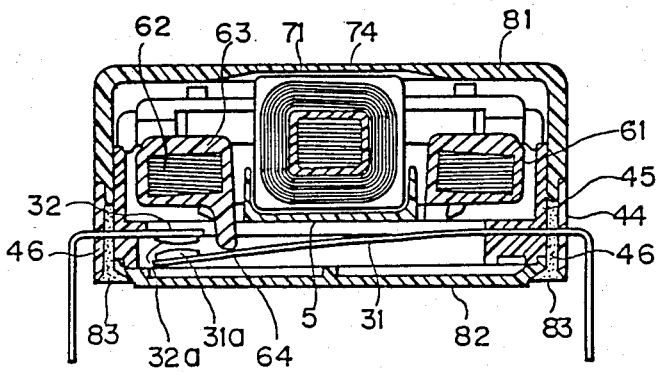
FIG. 12 is an assembled sectional view showing the electromagnetic relay of FIG. 11.

The procedure of assembling an electromagnetic relay using the above base 4 will now be described. As shown in FIG. 11, the insulating plate 5 is mounted on the base 4 as projections 51 of the former are passed into the holes 43 formed in the latter. Then, an armature 6, with journals 66 affixed to its drive shaft, is rotatably mounted on the base 4 in such a manner that the journals 66 are accommodated in said arcuate recesses 42 of the base 4. The armature 6 is an insert-molded element comprising a permanent magnet bar 61 and an iron yoke 62 embedded in parallel within a synthetic resin matrix 63, and has, in addition to said drive shaft 65, a plurality of projections 64 for depressing the relatively resilient contact members 31 of base 4. The projections 47 of the base 4 are passed through holes 73 of the electromagnet element 7 and caulked to secure the electromagnet 7 rigidly to the base 4, whereby the journals 66 are securely retained in the recess 42. The electromagnet 7 is an insert-molded element consisting of an iron bar core 71 as embedded in a synthetic resin matrix 72, the central portion of the element forming a spool means supporting a coil winding 74. Leads 75 of said coil winding 74 are soldered to connectors 33*a* of coil terminal members 33 which are projecting from the base 4. Then an upper case 81 and a lower case 82 are fitted onto the base 4 from both sides thereof and a sealing agent 83 is filled into the channel 46 from the reverse side of the base 4 and allowed to cure in situ, whereby the upper case 81, lower case 84 and base 4 are secured together and, at the same time, the inside of the assembly is sealed against the outside atmosphere (See FIG. 12). Since the sealing agent 83 filled into the channel 46 adheres to external surfaces of all the terminal members 31, 32 and 33, no clearance is left over around each terminal member so that a perfect seal is established. That is to say, when the terminal members of this electromagnetic relay are subsequently soldered to a printed circuit board, for instance, the soldering flux is prevented from entering the inside of the relay. If terminal members are simply insert-molded with a resin base, small gaps tend to be created between the resin and terminal members, but the formation of such gaps is completely precluded in this invention. The electromagnetic relay thus constructed functions in such a manner that when the coil terminals 33 are connected to a power supply, the electromagnet 7 is energized to drive the armature 6 so as to establish an electrical connection between the confronting resilient contact member 31 and terminal member 32 or break the connection between 31 and 32 (open or close the contact). The insulating wall 41 extending downwards from the base 4 is intended to protect the other contacts against the arcs produced on actuation of the particular contact. Because the abovementioned wall 41 is configured as a rib, it functions also as mechanical stiffener for the base 4.

It will be apparent from the foregoing description that this invention provides a contact switching device via an extensively automated production process which contributes significantly to cost reduction.

What is claimed is:

1. A method of producing a contact switching device comprising:

a step of pressing an electrically conductive metal sheet to form a lead frame having at least one relatively resilient contact member extending from one of terminal portions and a stationary contact member extending from the other terminal portion, said relatively resilient contact member and said stationary contact member being disposed in mutually opposed and spaced apart relation, a step of bending external rim portions of said lead frame while said relatively resilient contact member is biased in such a manner that the opposed relatively resilient contact member and stationary contact member are brought together into partially overlapping relation, a molding step for forming an insulating base at base portions of said two terminal members, and a terminal-forming step of cutting said lead frame to leave two terminal portions.

2. A method of producing a contact switching device according to claim 1, further comprising a step of forming a contact point each at a free end of said relatively resilient contact member and at a free end of the corresponding stationary contact member in said overlapping position.

3. A method of producing a contact switching device according to claim 1, wherein said bending step is a single press operation involving the use of a die and a punch.

4. A method of producing a contact switching device according to claim 1, further comprising a step of assembling a contact drive element comprising an electromagnet for depressing said relatively resilient contact member from the top of the molded base.

* * * * *